United States Patent [19]

Cischke

[11] Patent Number: 4,565,251

[45] Date of Patent: Jan. 21, 1986

[54] POST DRIVING DEVICE

[76] Inventor: Michael R. Cischke, D-19 Twyckingham Apt., 4634 S. Hagadorn, East Lansing, Mich. 48823

[21] Appl. No.: 593,715

[22] Filed: Mar. 26, 1984

[51] Int. Cl.[4] ..... B23B 45/16

[52] U.S. Cl. ..... 173/128; 173/130; 173/132

[58] Field of Search ..... 173/128, 130, 139, 129; 405/231, 232; 428/288, 290, 435, 902

[56] References Cited

U.S. PATENT DOCUMENTS

| | | | |
|---|---|---|---|
| 2,214,295 | 9/1940 | De Biasi | 173/130 |
| 2,360,432 | 10/1944 | MacKenzie | 173/128 X |
| 3,645,345 | 2/1972 | Olsen et al. | 405/232 X |
| 3,920,083 | 11/1975 | Makita | 405/232 X |
| 4,479,552 | 10/1984 | Chappelow, Jr. | 428/288 X |

FOREIGN PATENT DOCUMENTS

| | | | |
|---|---|---|---|
| 186196 | 9/1936 | Switzerland | 173/128 |
| 458635 | 9/1975 | U.S.S.R. | 173/128 |

*Primary Examiner*—E. R. Kazenske
*Assistant Examiner*—Willmon Fridie, Jr.
*Attorney, Agent, or Firm*—Ian C. McLeod

[57] ABSTRACT

A driving device (10) for removable attachment to a post (100) to allow driving of the post into the ground is described. The device is characterized by a body portion (12) which loosely fits onto the end of the post and a cap portion (11) closing one end of the body portion to provide a surface (11*a*) for driving the post into the ground. Retaining means along one side of the body portion is provided in the form of a curved spring (13) which engages a side (100*a*) of the post. On the opposite side (100*b*) of the post a spring (18) loaded arm (15) urges a hook (17) into the side (100*b*) to stabilize the device during driving and to allow rapid removal of the device. The device is removed without damage to the post after driving.

7 Claims, 4 Drawing Figures

FIG. 1
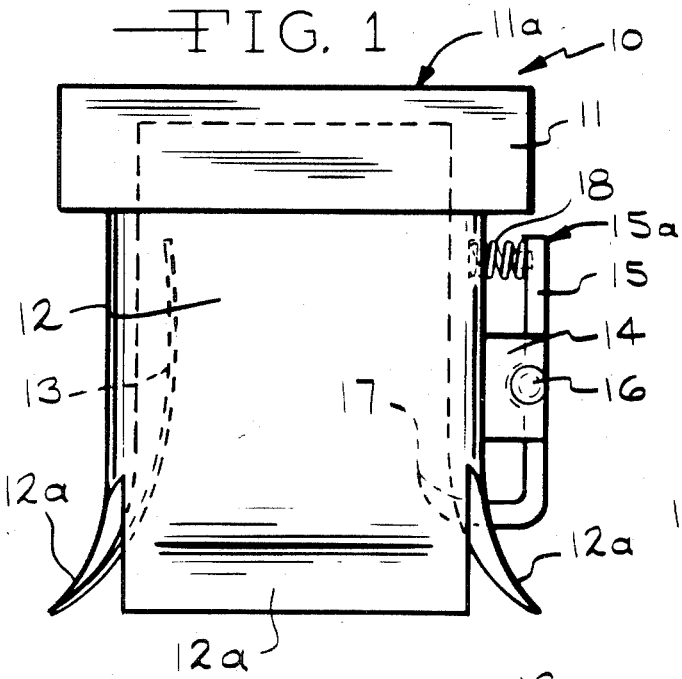
FIG. 2
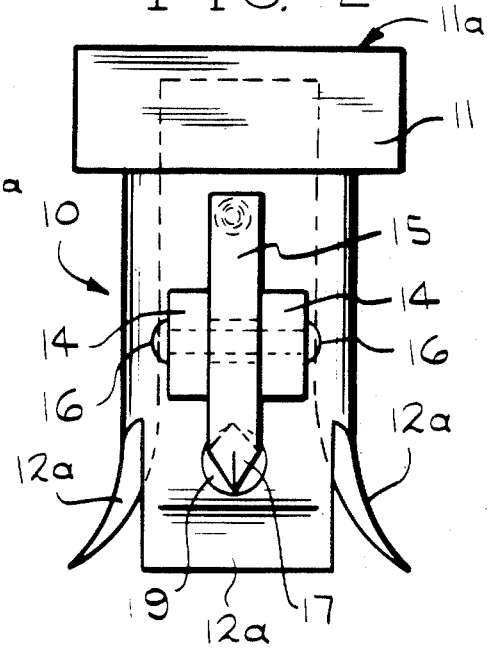
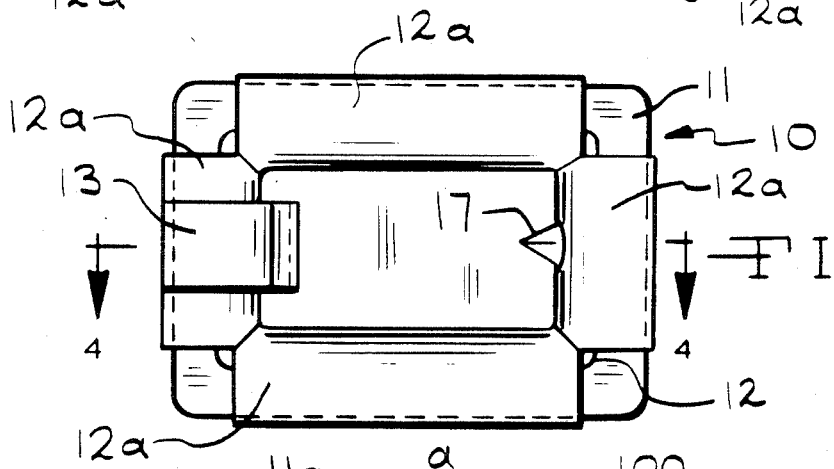
FIG. 3
FIG. 4
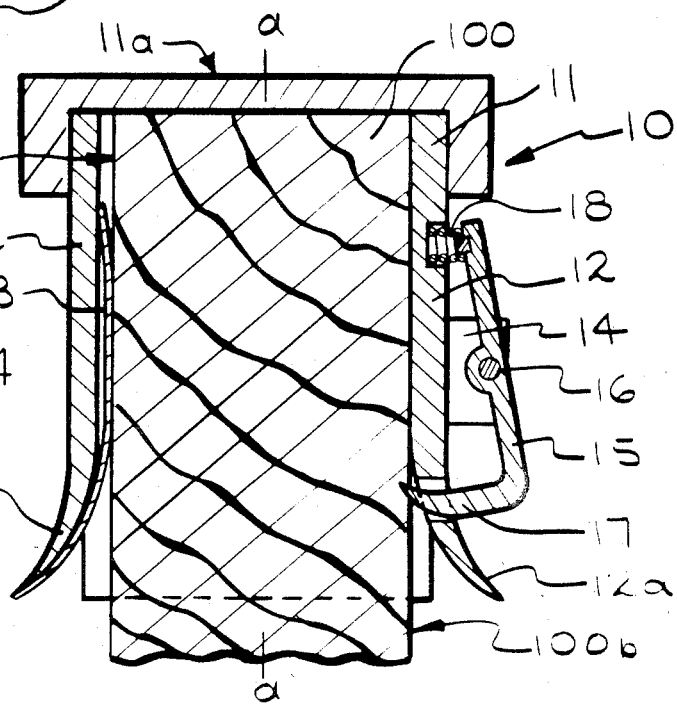

POST DRIVING DEVICE

BACKGROUND OF THE INVENTION

1. Field of the Invention

The present invention relates to a novel driving device (10) for impacting a post into the ground, particularly a 1"×3" or 2"×4" post. The device is unique in that a body portion loosely fits on an end of the post and is held in place by retaining means including clamping members (13, 15) which hold the post in place while it is being driven and which quickly release after the post has been driven.

2. Prior Art

The prior art relating to post driving is quite old and is illustrated by U.S. Pat. No. 59,990 (1866) to Foley; U.S. Pat. No. 407,348 (1889) to Green; U.S. Pat. No. 480,941 (1892) to Stow and U.S. Pat. No. 1,298,379 (1919) to Osten. The devices either fit over the end of the post or provide a means for attachment to the side of the post. With the devices shown by Stow and Osten, the connection of the driver to the post can damage the post and there is a risk that the end of the post can be damaged. The devices are complicated or fragile. With the devices shown by Foley and Green the end of the post can be damaged because the driver device can move relative to the end of the post.

OBJECTS

It is therefore an object of the present invention to provide a driving device (10) which is firmly retained over the end of the post (100) during driving and which is quickly and easily removed after the post has been driven. Further it is an object of the present invention to provide a post driving device which is inexpensive to construct and simple to use. These and other objects will become increasingly apparent from the following description and from the drawings.

IN THE DRAWINGS

FIG. 1 is a front view of the post driving device (10) of the present invention particularly illustrating the retaining means in broken lines on the inside including a spring (13) and a hook (17) adapted to engage opposite sides (100*a*, 100*b*) of a post (100).

FIG. 2 is a side view of the post driving device shown in FIG. 1, particularly showing an arm (15) supporting the hook (17).

FIG. 3 is a bottom plan view of the driving device of FIG. 1, particularly showing the spring (13) and hook (17) on opposite sides of the body portion (12).

FIG. 4 is a cross-sectioned view along line 4—4 of FIG. 3 with the post (100) in position and particularly showing the spring (13) and the hook (17) mounted on the arm (15) which is coil spring (18) loaded to force the hook into the post.

GENERAL DESCRIPTION

The present invention relates to a driving device (10) adapted to fit on an end and over sides of a post (100) having a vertically oriented longitudinal axis (a—a) defining the direction the post is to be driven which comprises a body portion (12) having an open end and a closed end adapted to loosely fit around the longitudinal axis adjacent the end of the post and along the sides of the post; a cap portion (11) secured on the body portion at the closed end to provide a surface (11*a*) for impacting the device for post driving; and retaining means (13, 17) mounted inside the body portion which clamps the driving device along opposite sides (100*a*, 100*b*) of the post while driving and quickly releases the device after the post has been driven.

The device of the present invention particularly uses a flat spring (13) and a hook (17) as the retaining means.

SPECIFIC DESCRIPTION

FIGS. 1 to 4 show the post driving device 10 of the present invention including the cap 11 and body portion 12. The cap 11 has a surface 11*a* which can be impacted by a hammer (not shown). Inside the body portion 12 on one side is a flat spring 13 attached at one end to a flare 12*a* of the body portion 12 which projects inside the body portion 12 such that the curve of the spring 13 is compressed on one side 100*a* when the device 10 is mounted on a post 100. On an opposite outside side of the body portion is provided spaced apart brackets 14 supporting an arm 15 pivoted on pin 16. The arm 15 has a coil spring 18 urging one end 15*a* of the arm 15 away from the body and urging the hook 17 on the opposite end of the arm 15 through an opening 19 in the body portion 12 so that the hook 17 engages the opposite side 100*b* of the post 100 from side 100*a*.

In operation the post driver 10 is impacted on surface 11*a* with a hammer or the like. The post 100 is driven along line a—a into the ground. The driving device 10 is then removed by depressing the end 15*a* of the arm to remove the hook 17 from the side 100*a* of the post 100.

It will be appreciated that the retaining means can be other than the hook 17 and spring 13 combination and can be a single or multiple flat springs 13 which engage the post 100 without the hook 17. Also, multiple hooks 17 can be used. Basically the retaining means clamps opposite sides 100*a* and 100*b* of the post 100 in a manner which allows a quick release of the device 10 from the post 100. The device 10 shown in FIGS. 1 to 4 is preferred.

The device 10 can be made of steel where the cap 11 is made of a piece of channel welded to a body 12 made of a piece of a hollow steel column. Alternatively the device 10 can be made of a plastic which resists breaking and the cap and the body portion are integral which is preferred.

I claim:

1. A driving device adapted to fit on an end and over sides of a post having a vertically oriented longitudinal axis defining the direction the post is to be driven which comprises:

(a) a body portion having an open end and a closed end adapted to loosely fit around the longitudinal axis adjacent the end of the post and along the sides of the post;

(b) a cap portion secured on the body portion at the closed end to provide a surface for impacting the device for post driving; and (c) retaining means mounted on the body portion which clamps the driving device on the post along opposite sides of the post while driving and quickly releases the device after the post has been driven, the retaining means including a hook with a curve towards the cap and being moveably mounted on the outside of the body portion so as to be driveable into the post through an opening in the body portion to hold the device on the post while the post is being driven and a curved flat spring mounted along the axis inside the device so that the device slides onto and off of the post on the spring and so that the spring engages at least one side of the post which compresses the spring to reduce the curve of the spring.

2. The device of claim 1 wherein the hook engages an opposite side of the post from the spring so as to clamp the driving device on the post.

3. The device of claim 2 wherein the hook is mounted on one end of an arm pivotably mounted on the outside of the body portion with a spring means between the arm and the outside of the body portion which urges the hook into the opening to engage the post.

4. The device of claim 3 wherein a pair of spaced apart brackets are mounted on the body portion with a pin between the brackets and through the arm so as to provide the pivotal mounting of the arm.

5. The device of claim 1 wherein the open end of the body portion has a flared end from the portion and wherein the curved spring is attached to the flared end and extends inside the body portion.

6. The device of claim 1 wherein the body and cap portion are composed of a plastic which can withstand driving without breaking.

7. The device of claim 1 wherein the cap portion includes a steel channel and wherein the body portion is a segment of a hollow steel column.

* * * * *